US005983475A

United States Patent [19]

Umling

[11] Patent Number: 5,983,475

[45] Date of Patent: Nov. 16, 1999

[54] APPARATUS FOR REPAIRING AND ASSEMBLING OF A VEHICLE TRANSMISSION

[76] Inventor: Samuel R. Umling, 3005 Monroe Way, Alpharetta, Ga. 30004

[21] Appl. No.: 09/249,976

[22] Filed: Feb. 12, 1999

[51] Int. Cl.[6] ..... B25B 27/14

[52] U.S. Cl. ..... 29/281.5

[58] Field of Search ..... 29/251, 261, 281.6, 29/281.5; 269/290, 309; 108/35

[56] References Cited

U.S. PATENT DOCUMENTS

| | | | |
|---|---|---|---|
| 1,447,769 | 3/1923 | Dover et al. | 29/251 |
| 3,745,637 | 7/1973 | Rutherford et al. | 29/261 |
| 4,104,776 | 8/1978 | Caccioli et al. | 29/281.3 |
| 4,507,835 | 4/1985 | Nankervis | 29/251 |
| 4,523,888 | 6/1985 | Pezzner et al. | 414/680 |
| 4,620,352 | 11/1986 | Sulej | 29/251 |
| 4,635,334 | 1/1987 | Diaz | 29/226 |
| 4,773,141 | 9/1988 | Seredich | 29/251 |
| 4,916,792 | 4/1990 | Haubus | 29/262 |
| 4,977,660 | 12/1990 | Maynard | 29/251 |
| 5,495,660 | 3/1996 | Choi | 29/732 |

*Primary Examiner*—Timothy V. Eley
*Assistant Examiner*—Benjamin Halpern
*Attorney, Agent, or Firm*—Bernstein & Associates

[57] ABSTRACT

A versatile bench mounted fixture for automotive repair applications is disclosed. The fixture, for assembling and testing a transmission, or removing a concentric member press fit to a shaft, for example, comprises a base having a first arm extending vertically therefrom. The fixture further includes a second arm fixed to the remote end of the first arm, and a pivotal support member pivotal from a midportion of the first arm. Finally, a third arm is provided and extends between a distal end of the pivotal support member and a temporary engagement with a free end of the second arm.

11 Claims, 7 Drawing Sheets

APPARATUS FOR REPAIRING AND ASSEMBLING OF A VEHICLE TRANSMISSION

FIELD OF THE INVENTION

The invention is directed to the field of bench presses or table mounted fixtures for the repair and assembly of vehicle transmission, more particularly to the alignment and testing of overdrive units and front clutch spring assemblies.

BACKGROUND OF THE INVENTION

This invention relates to a vertical column press assembly that is especially adapted to assemble a transmission, or at least a subassembly thereof, with precision and accuracy. The components of the subassembly, to be more fully discussed hereafter, are a housing, a compression spring, a lip seal, a bird cage, and a snap ring.

The present system was developed to overcome many shortcomings that were practiced by mechanics in the repair and assembly of vehicle transmissions, leading to much wasted time and potential injury to components and even the operators.

The prior art offered little help to overcome these shortcomings, thereby requiring a new approach to achieve the accuracy and precision of this invention. Exemplary prior art patents are described below, where it will be apparent that solutions to the problems overcome herein are not present. U.S. Pat. No. 4,104,776, to Caccioli et al., relates to a press for automotive applications. Specifically, the press includes a center column mounted on a base with a vertically extending center wall interconnecting two opposed, vertically extending side walls to define at least one vertically extending channel on each side of the center wall. Press means are mounted within one of the channels and include a moveable ram adapted to travel in a vertical direction to effect a pressing operation. A work table is adjustably mounted in the one channel between the press means and the base and may include an adjustable, self-storing leveling bar. A nesting block is pivotably mounted within the one channel between the press means and the work table.

U.S. Pat. No. 4,507,835, to Nankervis, teaches an adjustable press jig for a front wheel strut assembly including a base support from the base plate of a hydraulic press over which a downwardly extendable ram is mounted. The jig includes a pair of upstanding supports spaced horizontally apart and with at least one of the upstanding supports mounted from the base for shifting toward and away from the other upstanding support. A first of the supports includes a mount supported therefrom for angular displacement about a horizontal axis extending transversely of a plane containing the upstanding supports, and is provided with a mounting shank portion generally paralleling and swingable in the aforementioned plane when the mount is angularly displaced about its axis of oscillation. The second of the upstanding support mounts a cradle assembly therefrom for adjustable positioning vertically therealong and for oscillation about a horizontal axis paralleling the first mentioned axis. The cradle may embracingly engage the strut portion of a horizontally disposed McPherson-type strut assembly including a wheel hub journaling portion at one end provided with a ball joint mounting bore generally paralleling the strut portion. The mounting shank may be secured through the mounting bore and the mount may be angularly positioned in concert with vertical adjustment of the cradle for support of the strut assembly with the wheel hub journaling portion axially aligned with the associated ram.

U.S. Pat. No. 4,523,888, to Pezzner et al., discloses a mobile engine handling and metalworking machine. The apparatus thereof includes a base with wheels and casters, a vertical post or mast extending from the base to support a boom to form a hydraulically activated crane or hoist, an engine stand to support a motor or like object, and a hydraulic press and press assembly, which is formed from parts that are interchangeable with parts from the hydraulically activated crane.

In U.S. Pat. No. 4,620,352, to Sulej, there is taught a floor supported shop press. The shop press includes a fixed-height table capable of supporting a workpiece. A ram assembly is mounted for vertical movement over the table. The ram assembly carries a fluid power head, and is arranged to permit the head to be moved horizontally so as to position the head at any desired location relative to the device table and a workpiece carried thereon. A system for vertically moving the ram assembly includes a cable arrangement connected between dual drums on the table and pulleys journaled on ram assembly legs. As the cable is wound upon or let off the drums, the ram assembly is moved upwardly or downwardly. A slip clutch and brake assembly permits the ram assembly to be moved upwardly without the interference of frictional force, but a frictional drag brake action is applied as the ram is moved downwardly to control such downward movement.

U.S. Pat. No. 4,635,334, to Diaz, is directed to an automatic transmission rebuilding tool. The tool has a table top mountable base with front and rear legs upwardly extending, and a working platform in between. An adjustable height extension member is sliceable connected within the rear leg and contains cavities on the sides to receive either a horizontal beam or an offset beam that extend above the platform. The extension member is adjustable in height positioning the beam at the desired location with a selected one of a series of jigs or fixtures and adjustably disposed on the end of the beam. This jig or fixture, holds the workpiece in compression against the platform and is individually adjustable by threaded rod compressing means having a manually operated handle. The beam that is not in use is stored in the remaining cavity on the extension member. Any combination of beam, jig, or fixture, may be utilized to correspond with the particular automatic transmission being rebuilt.

The patent to Haubus, U.S. Pat. No. 4,916,792, relates to a tool for use in connection with mechanical clutches for automobiles. The tool thereof specifically is intended to align a clutch plate with a pressure plate. The tool includes an externally threaded tube having an adjustable clamping member engaged therewith for axial movement relative thereto. The tube comprises a stepped bore including a step between bore portions of differing diameter. An axially slidable bolt passes through the tube and has a nut at one end and a head at the other end. An elongate insert extends into the bore, and at one end thereof abuts against the step within the bore. The other end of the insert is formed as an enlarged deformable portion and is adapted to be radially expanded by the head of the bolt being drawn into it when the nut is tightened.

Finally, U.S. Pat. No. 5,495,660, to Choi, discloses apparatus for inserting a shaft into a gear. The apparatus includes a substrate, a handle and a chuck. The chuck has a cylindrical housing into which a motor fixing member is inserted, a piston between an inner upper portion of the housing and an upper portion of the motor fixing member. The motor fixing member receives a motor and supports a rear portion of the motor when pushing force is directed from an upper portion of the piston by a spring. A pushing force is applied to the piston by rotating an external lever.

While the foregoing patents are directed to fixtures and tools to assist in assembling various automotive components, none teach a fixture, as disclosed hereafter, to precisely and accurately align and test an overdrive unit and front clutch spring assembly of a transmission for a vehicle. The manner by which this is achieved by the present invention will become apparent to those skilled in the art, particularly automotive mechanics, from the following specifications, especially when read in conjunction with the accompanying drawings.

SUMMARY OF THE INVENTION

A first embodiment of the invention is directed to a bench mounted fixture, having a constant and exact center point, for receiving a transmission housing for assembling and testing the components thereof, the fixture comprises a base having a first arm extending vertically therefrom, where a first end is fixed to the base and a free end mounts a second arm essentially parallel to the base, the second arm includes a threaded rod, coaxial with a precise axial center line, for applying an axial pressure to the assembled components. The fixture further includes a pivotal transmission housing support mounted for limited pivotal movement at an intermediate location along the first arm, where the support has a central aperture coextensive with the axial center line, and a third arm pivotally mounted to a distal end of the support for temporarily engaging with a free end of the second arm, in operation, the support may be pivoted to a non-horizontal position to receive the transmission housing, followed by pivoting the support to a horizontal position and temporarily engaging the second and third arms. For this first embodiment, a shaft support member is positioned on the pivotal support, where the shaft support member includes plural means to apply air pressure checks for determining the integrity of the various functions of the assembled components.

For a second embodiment, which may be useful for removing a concentric member, such as a carrier bearing press fit onto a carrier assembly, a modified pivotal member is provided.

Accordingly, an object of the present invention is to provide a bench fixture for automotive repair applications, such as a clutch pack for a transmission, incorporating a constant and exact center point to avoid slippage and potential damage to parts or injury to personnel.

Another object is the provision of a means for checking the integrity of the clutch assembly to determine clearances and tolerances.

Still a further object is to allow a technician to assemble all front clutch assemblies to be compressed and disassembled with maximum efficiency.

These and other objects will become apparent to those skilled in the art from the following description, particularly when read in conjunction with the accompanying drawings.

DETAILED DESCRIPTION OF PREFERRED EMBODIMENT

The present invention relates to a vertical column or bench mounted press designed particularly for transmission repair, such as overdrive units and front clutch spring assemblies. The press is needed to make adjustments to parts that contain heavy springs, such as clutch springs. Further, the press hereof is constructed to automatically center with respect to a ram. As a consequence, the operation of the press is safer for the operator and less likely to damage the various components due to the elimination of misalignment of parts during assembly or repair.

Figure 1:
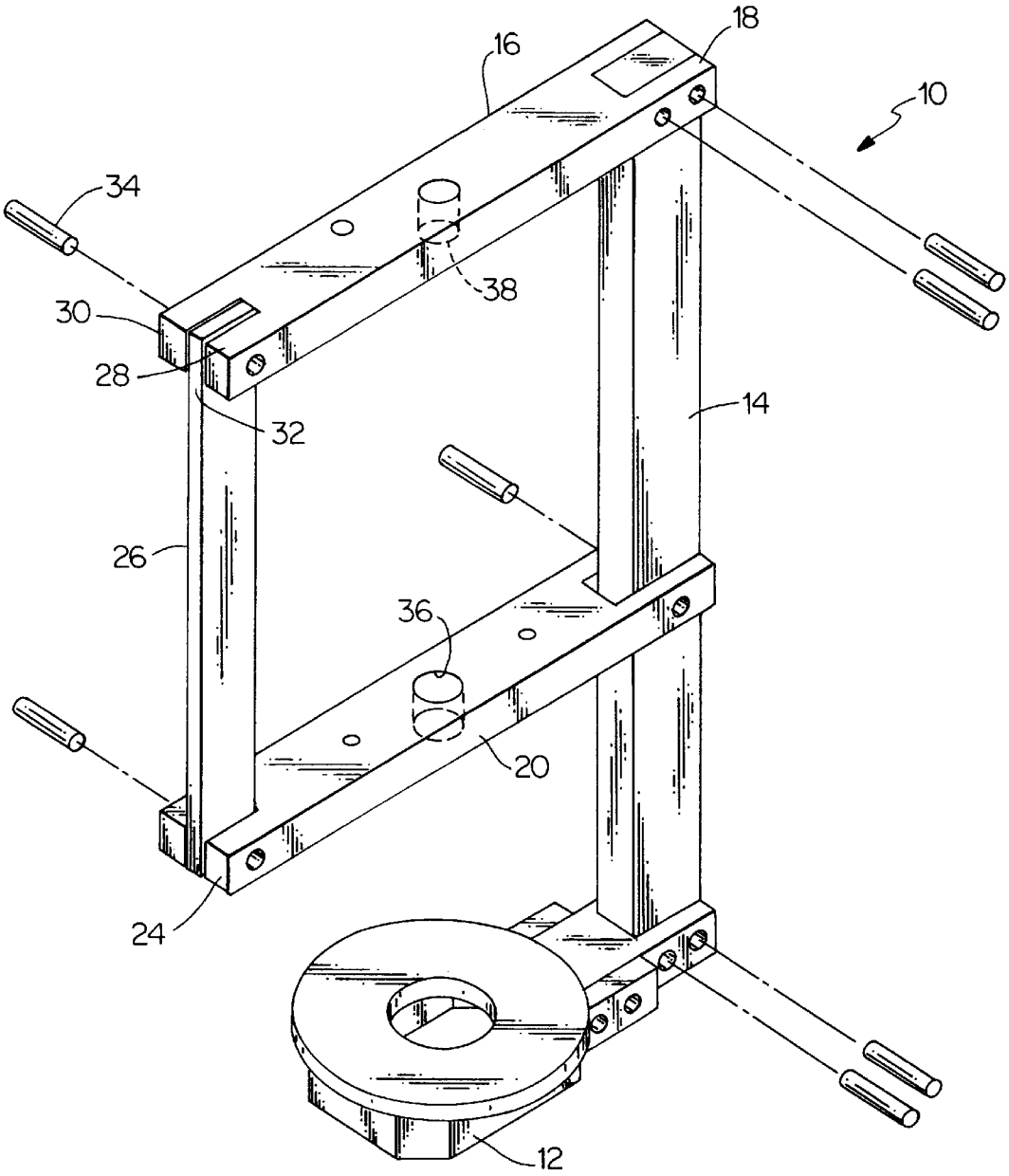
FIG. 1 is a partially exploded view of a bench mounted fixture according to the present invention.
Figure 2:
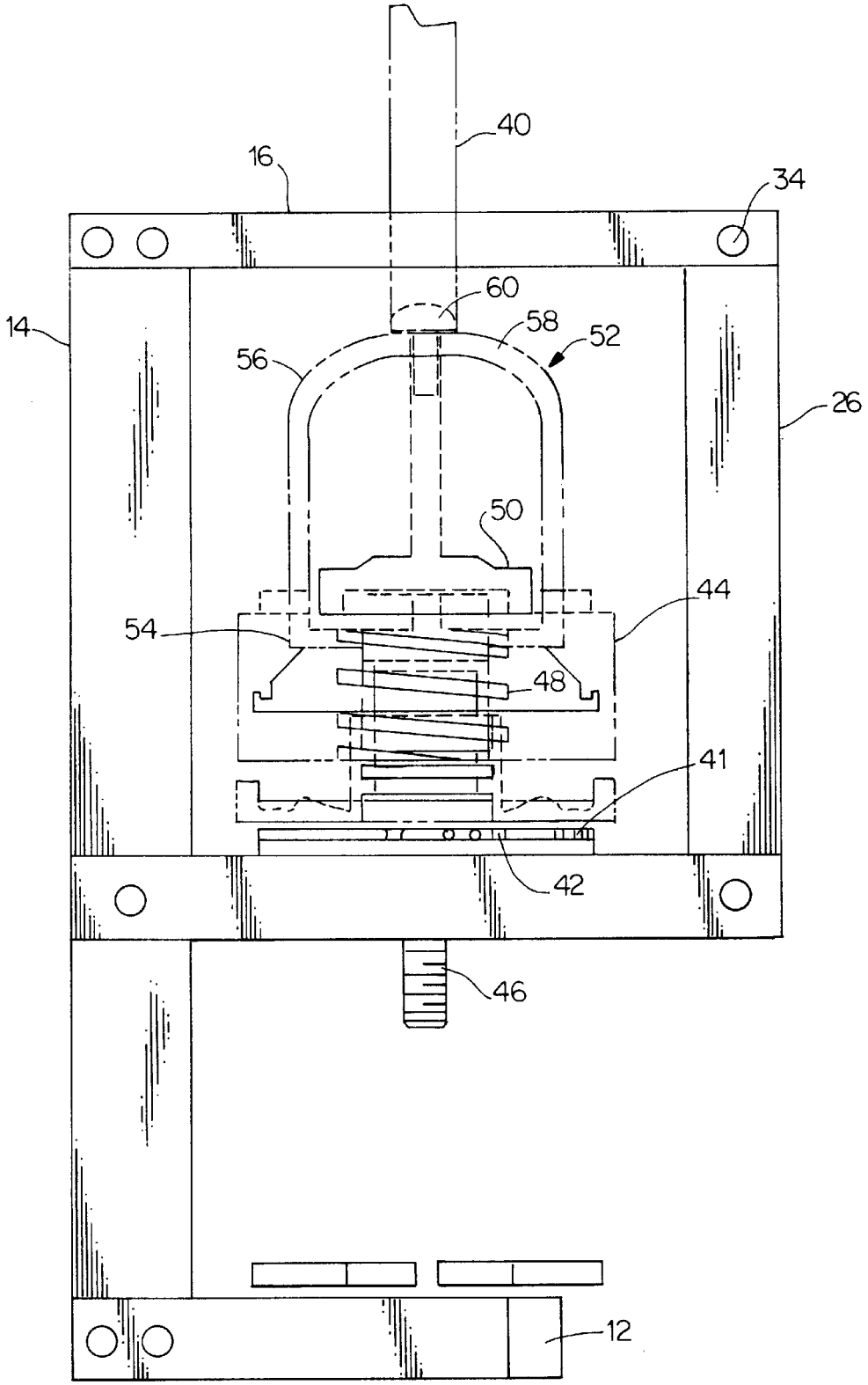
FIG. 2 is a plan view of the bench mounted fixture of claim 1, illustrating further the assembled transmission with the various components positioned therewithin.

Turning now to the several Figures, where like reference numerals represent like components or features throughout the various views, FIG. 1 illustrates a preferred embodiment for the vertical column or bench mounted press according to this invention. The bench press 10 hereof comprises a base 12, securable to a bench top, having a vertical column or arm 14 projecting therefrom, and an upper arm 16 extending from remote end 18, where such upper arm is generally parallel to the base 12. At an intermediate position along the vertical arm 14 is a partially pivotal support 20, pivotal about 60 degrees from pivot point 22. The distal end 24 of pivotal support 20 mounts a pivotal arm 26. The distal end 28 of pivotal arm 26 is designed to removably or temporarily engage the free end 30 of upper arm 16. As best seen in FIG. 2, said free end 30 may include a slot 32 configured to receive the pivotal arm 26. To temporarily secure same together, said distal end 28 may include a horizontally disposed rod 34 to override the slot 32.

For the preferred pivotal support 20, a central aperture 36 is provided. Axially aligned with said aperture is a threaded opening 38 along the upper arm 16, where the threaded opening 38 receives threaded member 40, which when turned will apply a compressive force to an assembly of components positioned between the upper arm 16 and pivotal support 20.

FIG. 1 illustrates a preferred use for the bench press 10 of this invention. Such Fig. shows an automotive transmission assembly positioned on the pivotal support 20. Lying directly on the pivotal support is a modified reaction shaft support 41 having plural, radially extending ports 42 to individually check the functions of the assembled transmission, such as may be for a front wheel drive model. The modification will become clearer hereafter with regard to FIG. 9. In any case, the assembly includes a housing 44, having an input shaft 46 seated in the aperture 36, where the mounting thereof may be effected while the pivotal support 20 is angled downwardly to provide clearance. Thereafter, or when all components have been mounted, the pivotal support is moved upwardly where the pivot arm 26 and upper arm 16 engage. In any case, further to the assembly is a compression spring 48, a lip seal 50, and finally a bird cage 52, which as known in the art, comprises an annular ring 54 having plural arcuate shaped arms 56 arranged thereabout and extending upwardly to join one another at the top 58. The top 58 is precisely positioned under the lower end 60 of threaded member 40. In this position, a clockwise movement of the threaded member 40 causes the compression spring 48 to compress to expose an annular groove in the transmission shaft to receive a snap ring therewithin, as known in the art. In the compressed state, the integrity of the assembly may be tested for the individual functions, such as the underdrive, overdrive, and reverse clutch. Heretofore, testing of the assembly was either a fail or pass. However, by the use of the modified reaction shaft support 41 hereof, the individual functions may be tested independent of one another.

Figure 8:
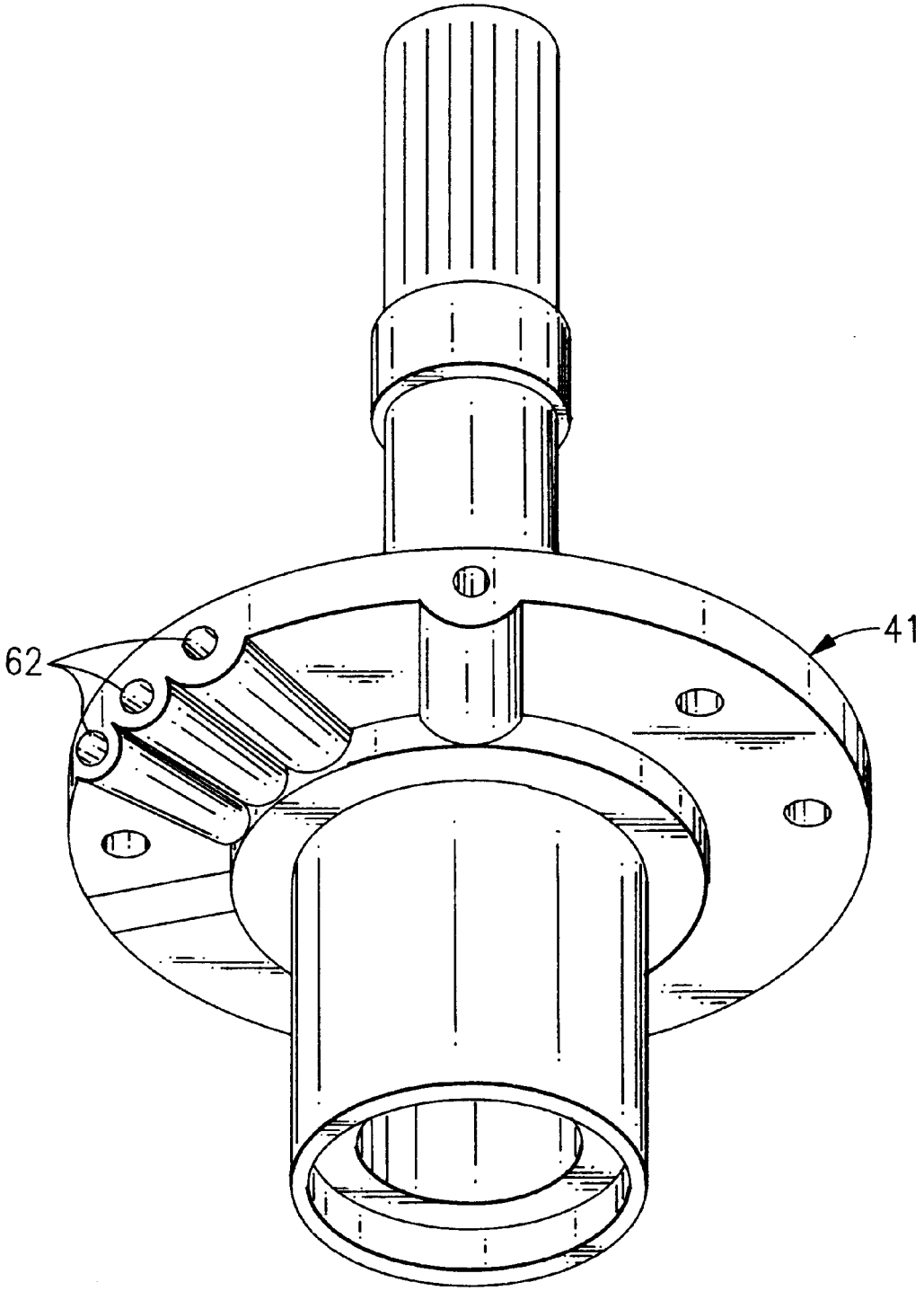
FIG. 8 is a first end perspective view of an exemplary reaction shaft support as used in an automotive transmission assembly.
Figure 9:
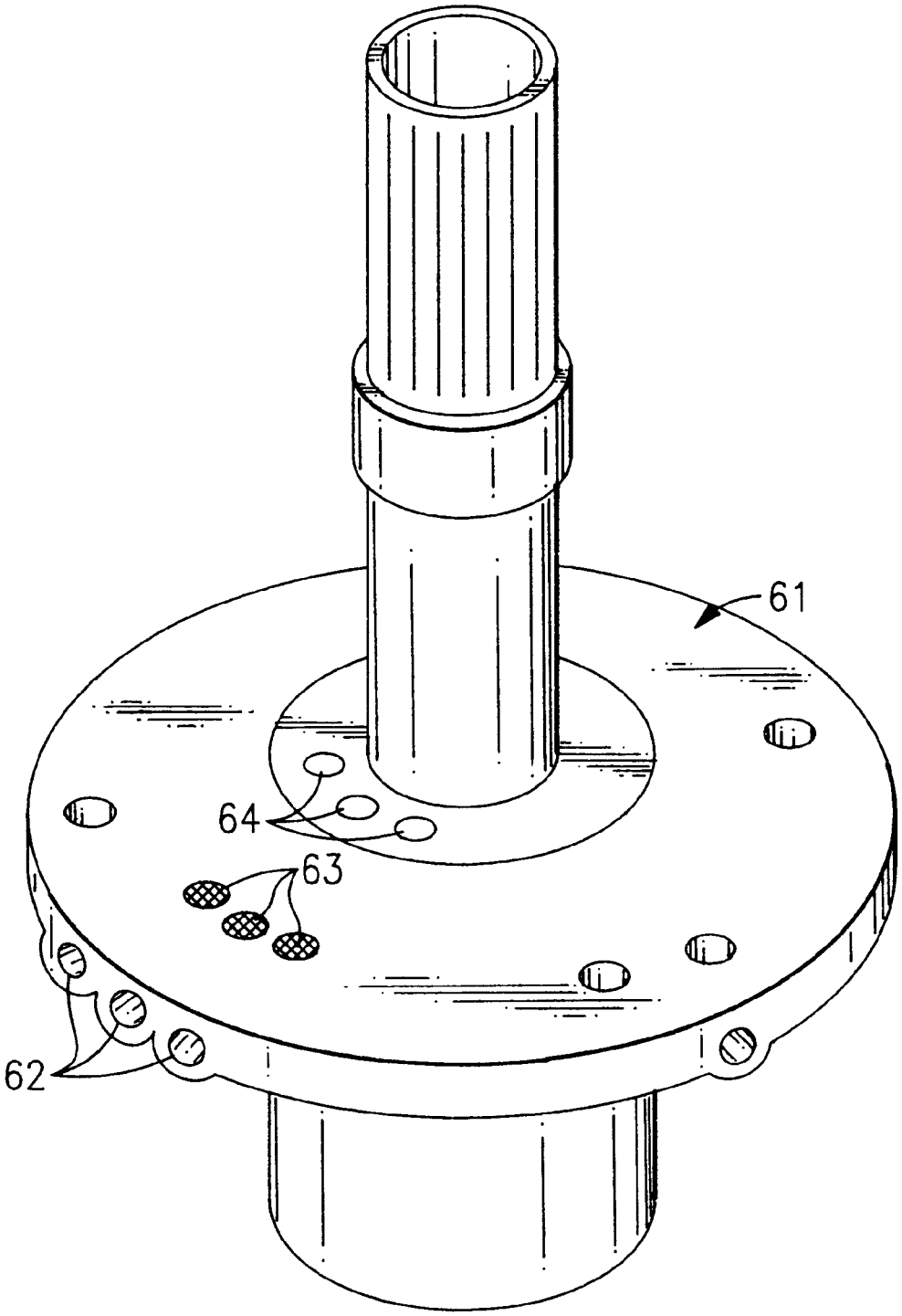
FIG. 9 is a second or opposite end perspective view of the reaction shaft support of FIG. 8, showing further the modification thereof for use in practicing this invention.

It may be helpful at this juncture to review briefly the modified reaction shaft support 41 as used herein. FIGS. 8 and 9, except as modified in the manner discussed later, illustrate a conventional reaction shaft support 61, which combine with a pump housing and inner and outer pump gears to form an oil pump. The oil pump, as known in the art, draws oil from the transaxle oil sump, pressurizes it and then directs it to the valve body through several side ports 62, where the pressurized oil is used to operate clutches, torque converter, and lubrication system.

In the system of this invention, the reaction shaft support has been modified as illustrated in FIG. 9. Such Figure shows the inner end of the reaction shaft support 61, where the ports 62 are normally in communication with complementary openings 63, 64 to effect the desired lubrication. However, in the invention hereof, the intermediate openings 63 or pressure ports are plugged up to allow testing through openings 64 of the individual functions of the assembly, as above described.

Figure 3:
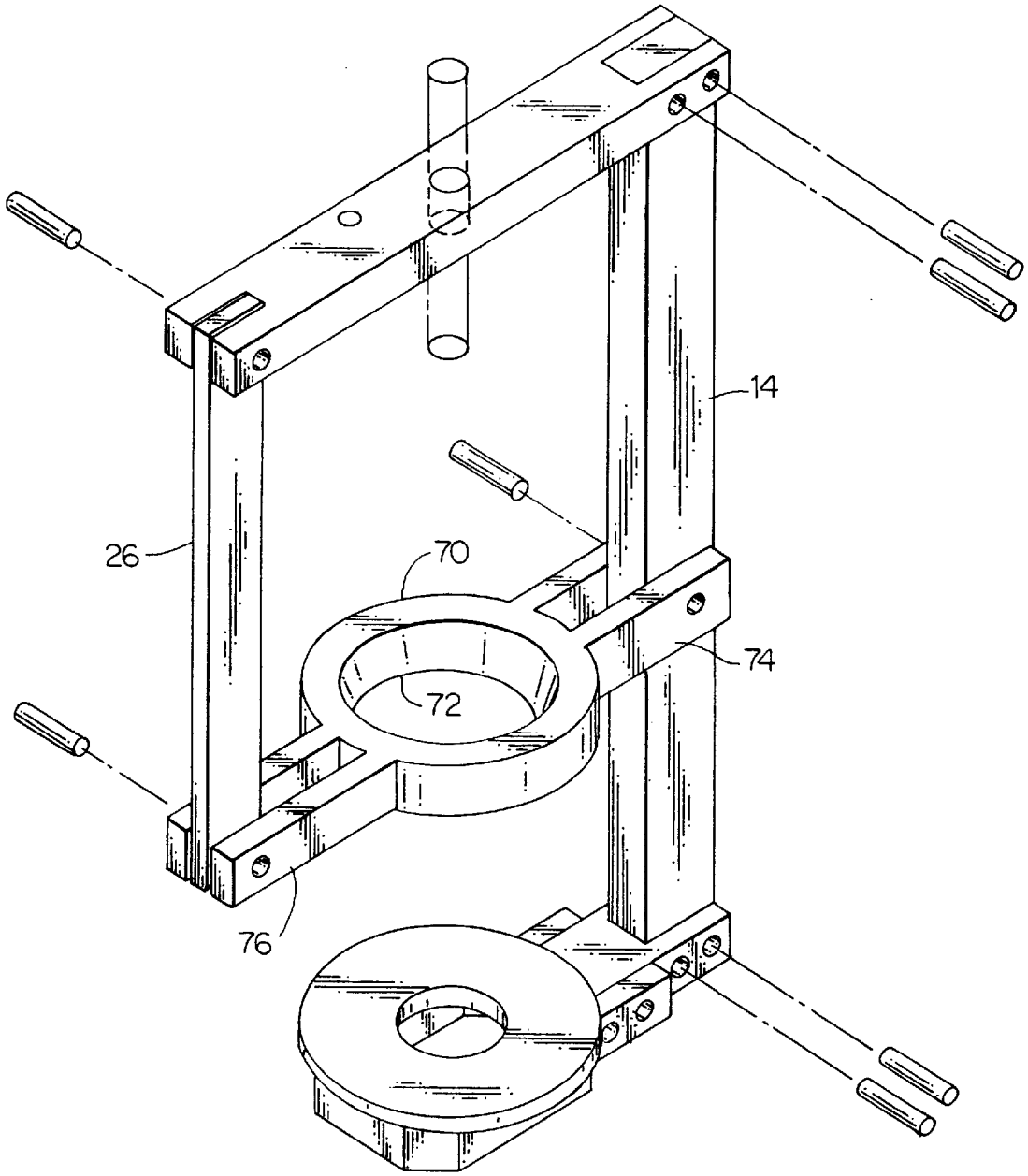
FIG. 3 is a partially exploded view, similar to FIG. 1, showing a modified bench mounted fixture of this invention.
Figure 4:
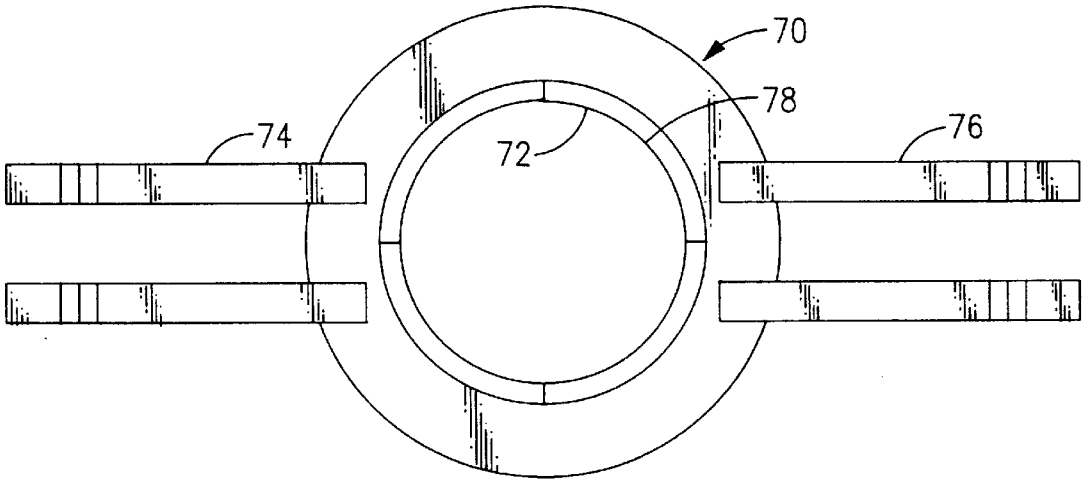
FIG. 4 is an enlarged top view of the intermediate, pivotal support member for the modified bench mounted fixture of FIG. 3.
Figure 5:
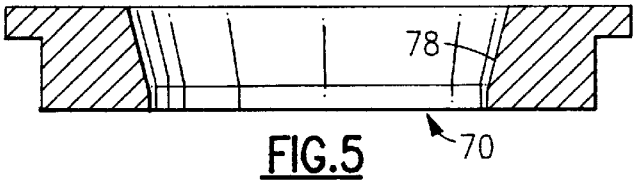
FIG. 5 is a sectional view taken laterally through the pivotal support of FIG. 4.
Figure 6:
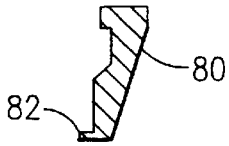
FIG. 6 is a sectional view of an exemplary wedge member to be positioned within the central aperture of the pivotal support of FIG. 4 and 5, where the arcuate dimension of the wedge member is an integral unit of the circumference of the central aperture.
Figure 7:
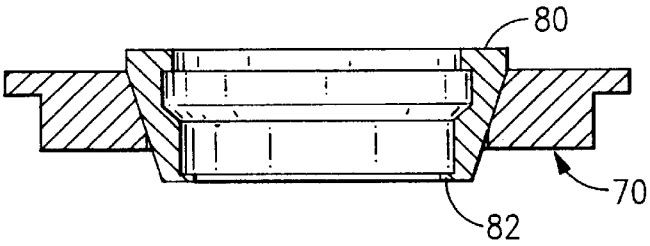
FIG. 7 is a sectional view illustrating the assembled relationship of the wedge member of FIG. 6 to the pivotal support of FIG. 5.

FIGS. 3 through 5 illustrate a modified pivotal support 70, and demonstrates the versatility of the bench press 10 of this invention. As best seen in FIGS. 3 and 4, the modified pivotal support 70 is an "eye" shaped member having a large central and tapered aperture 72 with aligned parallel sets of arms 74, 76 extending oppositely therefrom. A first set of arms 74 are mounted for pivotal movement on vertical column or arm 14, pivotal for movement over a range of about 60 degrees, with the other set of arms 76 receiving pivotal arm 26. The central tapered aperture 72, as shown in the sectional view of FIG. 5, is tapered 78 inwardly to further restrict the opening thereof. Such restricted opening cooperates with and is designed to receive plural arcuate-shaped wedges 80, see the cross-section of an exemplary wedge in FIG. 6. Plural wedges 80 are preferred, where the arcuate length or dimension is an integral unit or equal fraction of the circumference of the central tapered aperture 72 such that they snugly fit and abut therewithin. In other words, if there are four such wedges, the arcuate length would be 90 degrees. And, for two wedges, the arcuate length is 180 degrees. In either case, the respective seated wedges 80 define an opening to receive a component press fit to a shaft. To hold such component, which may be a carrier bearing press fit onto a carrier assembly, as known in the art, the respective wedges include a lip or flanged portion 82, which cooperate to define a continuous mounting support to the carrier assembly.

Figure 10:
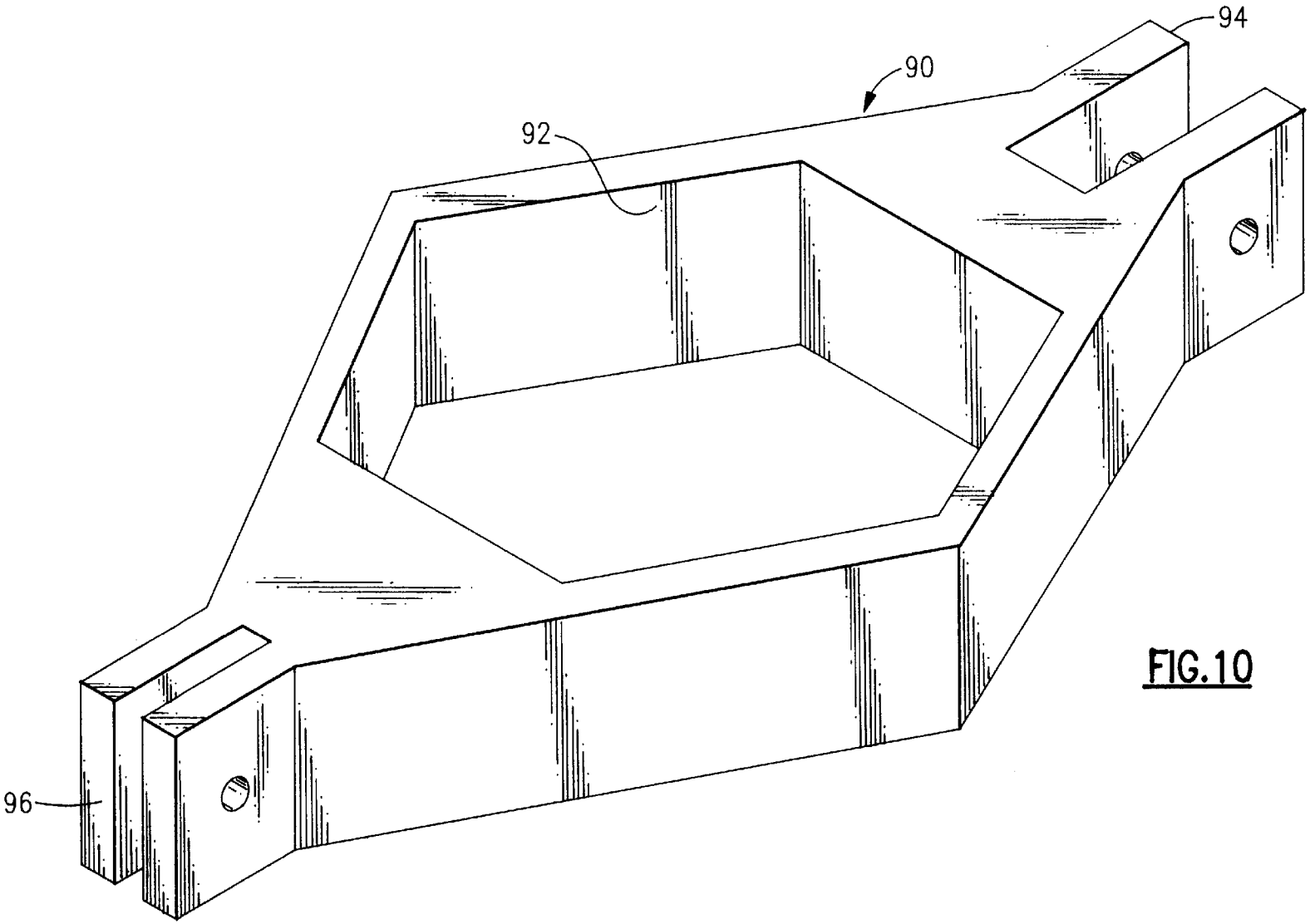
FIG. 10 is a perspective view of a modified pivotal support member for the bench mounted fixture of this invention.

Finally, FIG. 10 illustrates an alternate embodiment for a pivotal support 90, where the central opening 92 is hexagonally configured. However, comparable to the pivotal support of FIG. 4, opposite ends of the support 90 further include aligned parallel sets of arms 94, 96 extending therefrom, where the respective sets function to allow pivoting about a bar mounted between the arms.

Briefly, and by way of background, the carrier bearing consists of a tapered bearing member having a circular race which, has been mounted by a negative fit onto the carrier assembly. When assembled, the race, having a smaller I. D. than the diameter of the carrier assembly is caused to elastically yield so as to fit thereon. Obviously, with such a negative press fit arrangement, considerable separating force is required to separate same. The present invention, by the use of the modified pivotal support, with the axially aligned threaded member 40 to provide the necessary separating force to release the respective components, the desired results may be achieved.

While a preferred and a modified embodiment has been described above, it is recognized that variations may be had with respect to the components thereof. Therefore, while the invention has been disclosed in preferred and modified forms only, it will be obvious to those skilled in the art that many additions, deletions and modifications can be made therein without departing from the spirit and scope of this invention, and that no undue limits should be imposed thereon except as set forth in the following claims.

I claim:

1. A bench mounted fixture, having a constant and exact center point, capable of receiving a transmission housing for assembling and testing the components thereof, said fixture comprising:

a. a base having a first arm extending vertically therefrom, where a first end is fixed to said base and a free end mounts a second arm essentially parallel to said base, and said second arm includes a threaded rod, coaxial with a precise axial center line, for applying an axial pressure to assembled components of the transmission housing, b. a pivotal transmission housing support mounted for limited pivotal movement at an intermediate location along said first arm, said support having a central aperture coextensive with said axial center line;

c. a third arm pivotally mounted to a distal end of said support for temporarily engaging with a free end of said second arm, whereby said support may be pivoted to a non-horizontal position to receive said transmission housing, followed by pivoting said support to a horizontal position and temporarily engaging said second and third arms; and, d. a shaft support member positioned on said pivotal support, said shaft member support including plural means to apply air pressure checks for determining the integrity of the various functions of the assembled components.

2. The bench mounted fixture of claim 1, wherein said free end of the second arm includes a longitudinal slot, and said third arm is slidably received therein.

3. The bench mounted fixture of claim 2, wherein said third arm includes a transverse rod to override said longitudinal slot.

4. The bench mounted fixture of claim 1, wherein said base includes a central aperture aligned along said axial center line.

5. The bench mounted fixture of claim 1, wherein shaft support member comprises a circular plate, and said plural means includes individual ports about the periphery thereof.

6. The bench mounted fixture of claim 5, wherein said shaft support member lies against said pivotal transmission housing support, and that said components include an input shaft for a transmission slidably received within said central aperture.

7. A bench mounted fixture, having a constant and exact center point for receiving a press fit assembly consisting of a concentric member on a shaft, and for separating the components of said assembly, said fixture comprising:

a. a base having a first arm extending vertically therefrom, where a first end is fixed to said base and a free end mounts a second arm essentially parallel to said base, and said second arm includes a threaded rod, coaxial with a precise axial center line, for applying an axial pressure to the assembly;

b. a pivotal support mounted for limited pivotal movement at an intermediate location along said first arm, said support having a central aperture coextensive with said axial center line;

c. a third arm pivotally mounted to a distal end of said support for temporarily engaging with a free end of said second arm, whereby said support may be pivoted to a non-horizontal position to receive said press fit assembly, followed by pivoting said support to a horizontal position and temporarily engaging said second and third arms; and, d. plural arcuate-shaped wedges adapted to secure said concentric member within said central aperture, whereby axial pressure by said threaded rod on said shaft will result in the separation of said concentric member from said shaft.

8. The bench mounted fixture of claim 7, wherein said free end of the second arm includes a longitudinal slot, and said third arm is slidably received therein.

9. The bench mounted fixture of claim 8, wherein said third arm includes a transverse rod to override said longitudinal slot.

10. The bench mounted fixture of claim 7, wherein said base includes a central aperture aligned along said axial center line.

11. The bench mounted fixture of claim 7, wherein said wedges include an inwardly directed flange portion to hold said concentric member against axial movement.

* * * * *